US008975521B2

(12) United States Patent
Huang et al.

(10) Patent No.: US 8,975,521 B2
(45) Date of Patent: Mar. 10, 2015

(54) SHIELDED FLAT CABLE AND CABLE HARNESS USING THE SAME

(75) Inventors: Detian Huang, Hitachi (JP); Takanobu Watanabe, Hitachi (JP); Hiroshi Komuro, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 277 days.

(21) Appl. No.: 13/412,398

(22) Filed: Mar. 5, 2012

(65) Prior Publication Data

US 2013/0062116 A1 Mar. 14, 2013

(30) Foreign Application Priority Data

Sep. 9, 2011 (JP) ..... 2011-197326

(51) Int. Cl.
*H01B 7/08* (2006.01)

(52) U.S. Cl.
CPC ..... *H01B 7/083* (2013.01); *H01B 7/0861* (2013.01)
USPC ..... 174/117 M

(58) Field of Classification Search
CPC ..... H01B 7/083; H01B 7/0853; H01B 7/0861
USPC ..... 174/117 M, 117 A
See application file for complete search history.

(56) References Cited

U.S. PATENT DOCUMENTS

| | | | | |
|---|---|---|---|---|
| 4,818,820 | A * | 4/1989 | LaRock | 174/36 |
| 5,556,300 | A * | 9/1996 | Parker | 439/497 |
| 5,635,677 | A | 6/1997 | Wood et al. | |
| 6,770,820 | B2 * | 8/2004 | Sakurai et al. | 174/117 F |
| 2003/0037957 | A1 * | 2/2003 | Ueno et al. | 174/128.1 |
| 2010/0089610 | A1 * | 4/2010 | Matsumoto | 174/117 F |
| 2012/0288703 | A1 * | 11/2012 | Masuda et al. | 428/221 |
| 2012/0305286 | A1 | 12/2012 | Aoyama et al. | |

FOREIGN PATENT DOCUMENTS

| | | |
|---|---|---|
| JP | A-07-505498 | 6/1995 |
| JP | 2001-067944 A | 3/2001 |
| JP | 2001-101934 A | 4/2001 |
| JP | 2011-146270 A | 7/2011 |
| WO | WO 2011-096576 A1 | 8/2011 |

OTHER PUBLICATIONS

Japanese Office Action dated Sep. 12, 2014 with English Translation.

* cited by examiner

*Primary Examiner* — Chau N Nguyen
(74) *Attorney, Agent, or Firm* — McGinn IP Law Group, PLLC

(57) ABSTRACT

A shielded flat cable includes a plurality of wires arranged in parallel, a fibrous member including a polyurethane elastic fiber and woven between the plurality of wires along the arrangement direction of the wires, and a shield layer including a conductive member that includes an adhesive layer on one surface thereof and covers an entire periphery of the plurality of wires such that the adhesive layer is in contact with the fibrous member.

15 Claims, 2 Drawing Sheets

SHIELDED FLAT CABLE AND CABLE HARNESS USING THE SAME

The present application is based on Japanese patent application No 2011-197326 filed on Sep. 9, 2011, the entire contents of which are incorporated herein by reference.

BACKGROUND OF THE INVENTION

1. Field of the Invention

The invention relates to a shielded flat cable placed in a limited wiring space inside a small electronic device such as a handheld terminal or mobile communication terminal which is recently desired to be further downsized, and a cable harness using the shielded flat cable.

2. Description of the Related Art

In a small electronic device such as a handheld terminal or mobile communication terminal, a flexible printed circuit (FPC) and a flexible flat cable (FFC) etc., which are relatively flexible and can be placed inside a small and thin flat electronic device, are often used as a signal transmitting wiring material by being placed at a joint etc. between a main body used as an operation part etc. of the small electronic device and a display such as a liquid crystal display.

JP-A-2001-101934 discloses a flat cable that plural thin wires (e.g., coaxial cables) are flatly arrayed and a polyester fibrous member is woven into between the plural thin wires in a direction substantially orthogonal to a longitudinal direction of the flatly-arrayed plural thin wires.

SUMMARY OF THE INVENTION

As the small electronic devices are currently desired to be even further downsized/thinned, a wiring space for the wiring material inside the small electronic devices tends to be more limited than before. According to the downsizing/thinning of the small electronic devices, some positions of the wiring space may be subjected to the limitation that a width of the wiring space or a wiring path form is not constant. Therefore, a flat cable capable of being suitably placed in such a limited wiring space is strongly desired as the wiring material.

In placing the flat cable at such a limited wiring space, the flat cable is often bent. However, when a FPC is placed being bent in the limited wiring space, a problem may arise that the FPC is broken due to a stress caused by the bending. In addition, in case of a FFC, a member for retaining a bent shape (e.g., an acetone tape, etc.) is required since the bent shape is not retained, and there is thus a problem that a thickness of the bent portion is increased by the retaining member and work processes of wiring the FFC are increased. The flat cable disclosed in JP-A-2001-101934 needs to use a weft that is flexible and soluble in a solvent, so that it may be subjected to a further limitation in designing that structure while allowing a wiring in the limited space as described above.

When the flat cable using a coaxial cable is bent and placed, it is not possible to retain the bent shape due to the strong resiliency like the FFC, the bent portion is loosened by a repelling force to return to the original shape. Thus it needs to fix it by a member for retaining the bent shape, whereby a problem may arise that the thickness of the flat cable may increase and the number of steps for placing the flat cable may increase.

In addition, in small electronic devices requiring a countermeasure against EMI (electro-magnetic interference) caused by unnecessary radiation, the FPC or FFC needs to have a shield layer. However, the shield layer causes an increase in thickness by that much and makes a flat cable hard and more difficult to bend. By contrast, thinning the shield layer may cause insufficiency of the EMI countermeasure.

Accordingly, it is an object of the invention to provide a shielded flat cable that can be easily bent and placed in a limited wiring space and also can retain a bent shape, and a cable harness using the shielded flat cable.

(1) According to one embodiment of the invention, a shielded flat cable comprises:

a plurality of wires arranged in parallel;

a fibrous member comprising a polyurethane elastic fiber and woven between the plurality of wires along the arrangement direction of the wires; and a shield layer comprising a conductive member that includes an adhesive layer on one surface thereof and covers an entire periphery of the plurality of wires such that the adhesive layer is in contact with the fibrous member.

In the above embodiment (1) of the invention, the following modifications and changes can be made.

(i) The fibrous member is expandable when being woven between the wires.

(ii) The fibrous member comprises a monofilament.

(iii) The fibrous member has an initial modulus of not less than 5 cN/dtex and not more than 30 cN/dtex.

(iv) The shield layer is bonded to the fibrous member by thermal fusion bonding.

(v) The an inner conductor of the plurality of wires comprises a soft copper wire having an elongation of not less than 10%, a tensile strength of not less than 160 MPa and not more than 400 MPa and a conductivity of not less than 95%.

(vi) The conductive member comprises a polyethylene terephthalate tape, a metal foil layer formed on one side of the polyethylene terephthalate tape, and the conductive adhesive layer formed on a surface of the metal foil layer.

The plurality of wires each comprise an outermost layer comprising a fluorine resin, have an outer diameter of not more than 0.28 mm, and are arranged at a wiring pitch of not more than 0.30 mm.

(2) According to another embodiment of the invention, a cable harness comprises:

the shielded flat cable according to the embodiment (1); and a connector attached to a terminal portion of the shielded flat cable.

POINTS OF THE INVENTION

According to one embodiment of the invention, a shielded flat cable is constructed such that it comprises a fibrous member of a polyurethane elastic fiber that is expandable even after being woven in a parallel arrangement direction of wires, whereby the cable can be elongated and contracted in a width direction thereof. This allows the shielded flat cable to be bent so as to match a wiring space having nonconstant width or wiring shape, and it is thus possible to place the shielded flat cable by suitably deforming it into such a shape that matches the narrow wiring space.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

A preferred embodiment of the invention will be described below in conjunction with the appended drawings.

Figure 1:
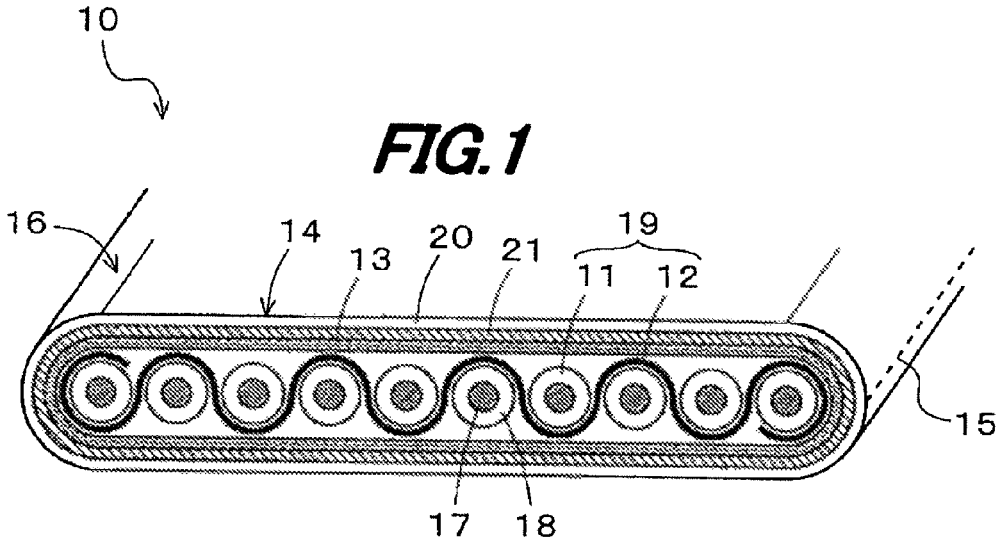
FIG. 1 is a perspective view showing a shielded flat cable in an embodiment according to the present invention.

FIG. 1 is a perspective view showing a shielded flat cable of the embodiment.

As shown in FIG. 1, a shielded flat cable 10 in the present embodiment has plural wires 11 arranged in parallel, a fibrous member 12 formed of polyurethane elastic fiber woven over and under the plural wires 11 along a parallel direction of the wires 11 (a direction substantially orthogonal to a longitudinal direction of the wire 11), and a shield layer 16 formed of a conductive member 14 which has an adhesive layer 13 on one surface thereof and covers the entire circumference of the plural wires 11 having the fibrous member 12 woven therebetween so that the adhesive layer 13 is in contact with the fibrous member 12.

The wire 11 is an insulated wire which has at least an inner conductor 17 and an insulator 18 provided on the outer periphery of the inner conductor 17. It is preferable that the inner conductor 17 be formed of a soft copper wire having an elongation of not less than 10%, a tensile strength of not less than 160 MPa and not more than 400 MPa and a conductivity of not less than 95%. Use of the flexible soft copper wire having high elongation and low tensile strength facilitates to maintain a bent shape when the shielded flat cable 10 is bent, and it is thus effective to wire the shielded flat cable 10 in a shape matching a wiring space. The insulator 18 is preferably formed of a fluorine resin such as tetrafluoroethylene-perfluoroalkyl vinyl ether copolymer (PFA), tetrafluoroethylene-hexafluoropropylene copolymer (FEP) and ethylene-tetrafluoroethylene copolymer (ETFE), etc. Use of a fluorine resin excellent in heat resistance, withstand voltage and bending resistance characteristics allows the insulator 18 to be thin in a thickness of not less than 0.03 mm and not more than 0.07 mm, and as a result, it is effective to thin the shielded flat cable 10.

Alternatively, the wire 11 may be a coaxial cable having an outer conductor formed by laterally winding plural metal conductors around the outer periphery of the insulator 18 in a spiral manner and a jacket provided on the outer periphery of the outer conductor. In this case, the outer conductor is a conductor (single or twisted wire) formed of a metal wire such as soft copper wire (including a wire with a plated surface). In addition, a jacket is formed of a fluorine resin as previously described. As described above, the outermost layer of the wire 11 is preferably formed of a fluorine resin excellent in heat resistance, withstand voltage, bending resistance characteristics, chemical resistance and chemical stability.

Considering that the wire 11 is placed in a narrow space inside small electronic devices which have been demanded to be smaller/thinner in recent years, an outer diameter of the wire 11 is preferably not more than 0.28 mm.

In addition to the wire 11, a metal wire may be provided as a drain wire at the outermost side (one or both sides) of the wires 11 in a parallel direction so as to be parallel to the inner conductor 17 when forming a flat cable body 19.

Figure 2:
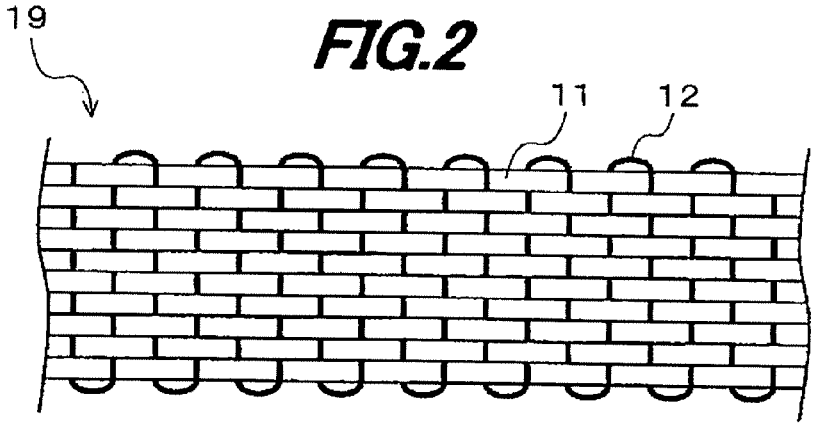
FIG. 2 is a plan view showing a flat cable body.

As shown in FIG. 2, the fibrous member 12 is woven between the plural wires 11 from one end to another in a longitudinal direction (from left to right side in the drawing) while reciprocating from one side to another in a width direction (from upper to lower side in the drawing) in a zigzag manner so as to fix the plural wires 11 in a flat manner in a longitudinal direction. The plural wires 11 having the fibrous member 12 woven therebetween is hereinafter referred to as a flat cable body 19.

At this time, the fibrous member 12 should be woven over and under units each consisting of one wire 11 at the widthwise middle portion of the flat cable body 19 (middle in a parallel direction of the wires 11). It should be noted that the widthwise middle portion of the flat cable body 19 is not limited to a portion of the flat cable body 19 on a center axis but includes the vicinity thereof.

By such a configuration, all the wires 11 of the flat cable body 19 are bound by the fibrous member 12, the plural wires 11 come close to each other and are arranged at a uniform wiring pitch, and it is thereby possible to reduce a width of the flat cable body 19.

Although the fibrous member 12 is woven throughout the whole length of the flat cable body 19, the fibrous member 12 at both lengthwise ends of the flat cable body 19 is removed in order to facilitate attachment of a connector used for connecting to a device. In this regard, the fibrous member 12 can be separated off from the wires 11 only by pulling the end portion thereof. Accordingly, it is possible to remove the fibrous member 12 without process of dissolving in a solvent, which allows connector attachment, etc., without spending time and efforts.

The flat cable body 19 is manufactured by weaving the fibrous member 12 over and under the plural wires 11 arranged in parallel, and is characterized in that a polyurethane elastic fiber (e.g., ROICA (registered trademark) manufactured by Asahi Kasei Fibers Corporation) is used as the fibrous member 12.

The polyurethane elastic fiber preferably has a very high elongation and a low initial modulus, such that an elongation percentage of not less than 500% and not more than 900%, a recovery percentage from elongation at 300% is not less than 90% and an initial modulus for 300% elongation is not less than 5 cN/dtex and not more than 30 cN/dtex. In addition, it is preferable that the fibrous member 12 be formed of a monofilament in light of improvement in strength and downsizing/thinning of the shielded flat cable 10 per se.

Here, the recovery percentage from elongation at 300% is obtained by a measuring method conforming to JIS L 1096. Meanwhile, the initial modulus for 300% elongation is obtained from a 300% modulus when a 5 cm-long test strand is elongated at a rate of 50 cm/min by using a tensile tester under conditions of a temperature of 20° C. and humidity of 65%.

For weaving the fibrous member 12 between the wires 11, use of such a polyurethane elastic fiber for the fibrous member 12 allows a very fine fiber (e.g., about 17 to 45 dtex) to be woven over and under the plural wires 11 in a state that the fiber is elongated (elongation of about 300%) (at this time, the outer diameter of the fibrous member 12 is about 0.04 mm or less). Meanwhile, after weaving the fibrous member 12 between the wires 11, a force of the fiber to recover from the elongation (to return to the original shape) (an elongation recovery force) acts so that the plural wires 11 are gathered close to each other. At this time, even if the outer diameter of the wire 11 is small, the wires 11 can be gathered close to each other by the elongation recovery force without applying stress which causes a small curvature, etc., on the wire 11. As a result, it is possible to reduce a distance between adjacent wires 11 (an arrangement pitch) without applying stress to the wire 11, and thus to reduce a width of the shielded flat cable 10 compared to the conventional art. Accordingly, it is possible to weave the fibrous member 12 without causing a wave on or breakage of the wire 11.

In addition, by using the polyurethane elastic fiber for the fibrous member 12, the plural wires 11 are bundled only by shrinkage of the fibrous member 12 after weaving the fibrous member 12 and the shape of the cable is prevented from naturally becoming a circular shape in a cross section, and the shape of the cable can be kept flat in a state that an external force to bend the cable is not applied.

Furthermore, since the fibrous member 12 formed of the polyurethane elastic fiber in a state of being woven in a parallel direction of the wires 11 can be elongated even after being woven, a function of being elongating and contracting the flat cable body 19 in a width direction thereof can be provided. This allows the shielded flat cable 10 to be bent so as to match a wiring space having nonconstant width or wiring shape, and it is thus possible to place the shielded flat cable 10 by suitably deforming it into a shape which matches the narrow wiring space. Note that, the shielded flat cable 10 can be bent at a desired portion in a longitudinal direction or at any portions in the longitudinal direction. In addition, a desired portion of the shielded flat cable 10 can be bent at a desired angle (e.g., greater than 0° and not more than 180°). Such deformations can be done at not only one portion but also plural portions of the shielded flat cable 10, or deformations such as bending, etc., can be simultaneously done at one portion.

Figure 4:
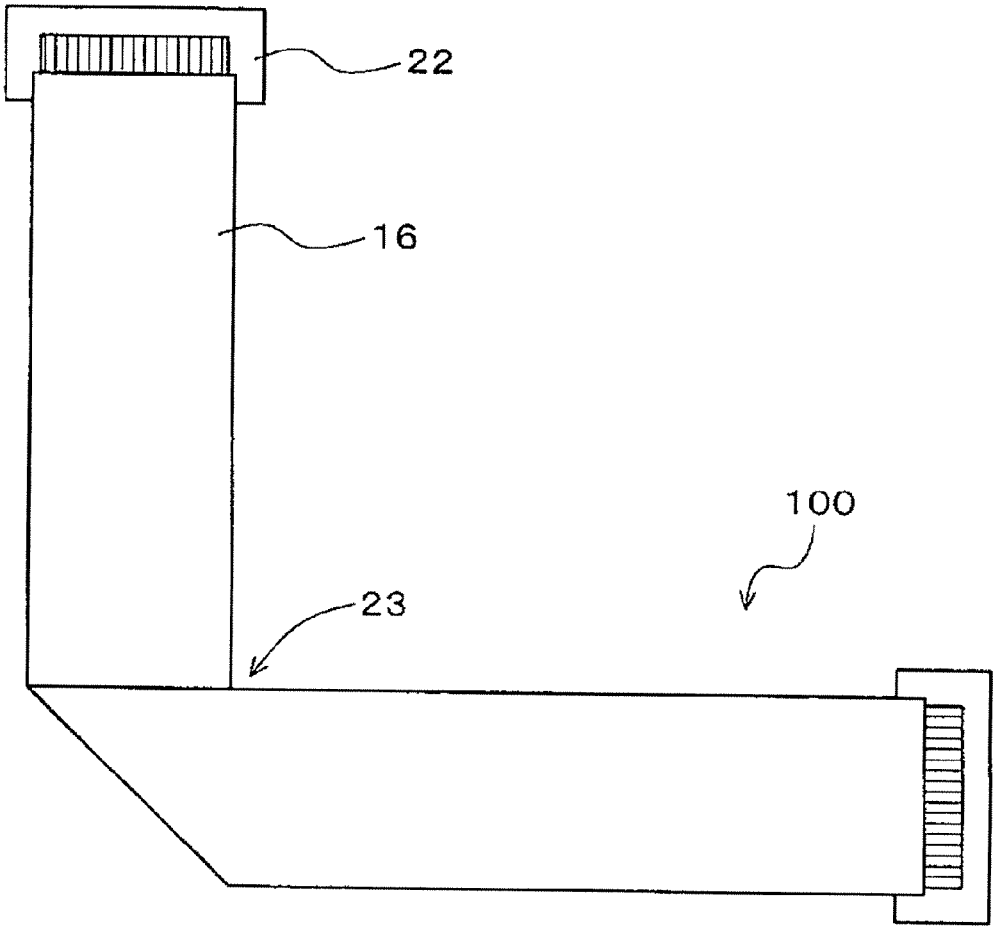
FIG. 4 is a plan view showing a cable harness using the shielded flat cable in FIG. 1.

In addition, in the shielded flat cable 10, the fibrous member 12 significantly thinned by elongation such as having an outer diameter of not more than 0.04 mm can be woven by using the polyurethane elastic fiber for the fibrous member 12, and since the fibrous member 12 has an elongation margin even after being woven, the shielded flat cable 10 per se is thin and easy to bend even if the shield layer 16 is present and it is possible to maintain the bent shape by excellent stretching properties of the fibrous member 12 without using a fixing member (without increasing work processes) (see FIG. 4).

Note that, since the initial modulus for 300% elongation of the fibrous member 12 is low such as not less than 5 cN/dtex and not more than 30 cN/dtex, it is possible to weave the fibrous member 12 without load on the wire 11.

When the initial modulus is less than 5 cN/dtex, a force of tightening the wires 11 at the time of weaving the fibrous member 12 is weak, and it is not possible to manufacture a well-shaped flat cable body 19. This raises the need of further providing a step of well shaping the fibrous member 12 after weaving the fibrous member 12, which leads to an increase in the manufacturing cost. Meanwhile, a wiring pitch of the wires 11 is likely to be wide when a force of tightening the wires 11 is weak and it is difficult to obtain a narrow pitch.

Meanwhile, when the initial modulus is more than 30 cN/dtex, a force of tightening the wires 11 at the time of weaving the fibrous member 12 is strong and the wire 11 is deformed in a wave-like manner or broken when the filament 12 is woven, which may lead to a decrease in electrical characteristics of the wire 11.

For the reason described above, a low initial modulus of not less than 5 cN/dtex and not more than 30 cN/dtex is preferable for 300% elongation of the fibrous member 12.

Meanwhile, since the fibrous member 12 formed of the polyurethane elastic fiber has a large friction coefficient and is woven between the plural wires 11 in a state of being elongated about 300%, it is possible to firmly bundle the wires 11 by the fibrous member 12 and positional misalignment caused by slippage of the wires 11 does not occur when the shielded flat cable 10 is bent. Therefore, the wiring pitch of the wire 11 is stable and the positional misalignment between the plural wires 11 less occurs when the shielded flat cable 10 is bent, hence, electrical characteristics are also stable.

Figure 3:
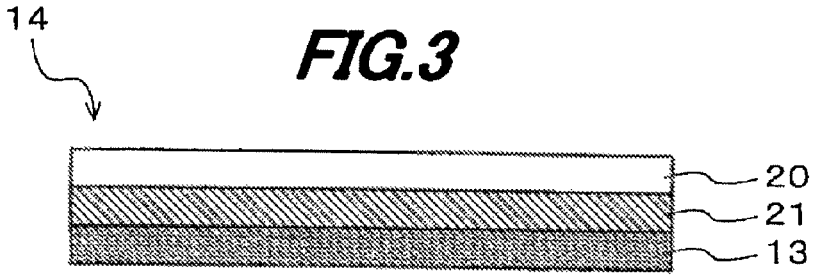
FIG. 3 is a cross sectional view showing an example of a conductive member.

As shown in FIG. 3, the conductive member 14 is composed of a polyethylene terephthalate (PET) tape 20 having a thickness of, e.g., not less than 5 μm and not more than 10 μm, a metal foil layer 21 formed on one surface of the PET tape 20 and having a thickness of not less than 5 μm and not more than 10 μm, and a conductive adhesive layer 13 formed on a surface of the metal foil layer 21 and having a thickness of not less than 5 μm and not more than 15 μm. The metal foil layer 21 is formed of a material excellent in shielding properties, such as silver or aluminum. The adhesive layer 13 is a hot-melt type and is thermal-fusion bonded to the fibrous member 12 by heating to not less than 110° C. That is, the shield layer 16 formed of the conductive member 14 is bonded to the fibrous member 12 by thermal fusion bonding. In the similar way, end portions 15 of the conductive member 14 which abut against each other are bonded by thermal fusion bonding, thereby forming the shield layer 16. As a result, even the wire 11 having the outermost layer formed of a fluorine resin excellent in chemical stability and being unlikely to be bonded to other material can be positioned with respect to the shield layer 16 via the fibrous member 12. The conductive member 14 is not limited to the configuration described above, and may be, e.g., a conductive cloth having the adhesive layer 13 on one surface. In addition, the end portion 15 of the conductive member 14 may be present at any positions, such as the middle portion of the flat cable body 19, instead of being provided at a position in a parallel direction of the wires 11 as shown in FIG. 1.

Meanwhile, EMI caused by unnecessary radiation from the shielded flat cable 10 can be suppressed by the shield layer 16. Since the shielded flat cable 10 has a thinned flat cable body 19, it is possible to easily bend and wire the shielded flat cable 10 even though the shield layer 16 is provided. In addition, in the thinned shielded flat cable 10, even if a coaxial cable is used as the wire 11, it is possible to maintain the bent shape without using a member for maintaining the bent shape since a force of the bent portion to return to the original shape is weaker than that in the FFC or a conventional flat cable.

In sum, since the shielded flat cable is provided with plural wires arranged in parallel, a polyurethane elastic fibrous member woven over and under the plural wires along a parallel direction of the wires and a shield layer formed of a conductive member which has an adhesive layer on one surface thereof and covers the entire circumference of the plural wires having the fibrous member woven therebetween so that the adhesive layer is in contact with the fibrous member, it is possible to provide a shielded flat cable which can be easily bent and placed in a narrow wiring space and also can maintain a bent shape.

Furthermore, in the shielded flat cable 10 of the present embodiment, since it is possible to weave the fibrous member 12 significantly thinned by elongation such as having an outer diameter of about 0.04 mm or less by using the polyurethane elastic fiber for the fibrous member 12, it is possible to realize further downsizing/decrease in width without extremely reducing the outer diameter of the wire 11, such that a wiring pitch of the wire 11 is not more than 0.30 mm and a thickness of the shielded flat cable 10 is not more than 0.30 mm, etc.

In a conventional flat cable, it is necessary to extremely reduce the outer diameter of the wire in order to realize further downsizing/decrease in width. However, extremely reducing the outer diameter of the wire may cause a wave on or breakage of the wire due to tension applied at the time of weaving the fibrous member and may deteriorate electrical characteristics of the wire.

Next, a harness using the shielded flat cable 10 will be described.

As shown in FIG. 4, a connector 22 is connected to a terminal portion of the shielded flat cable 10, thereby obtaining a cable harness 100 which can be easily bent and placed in a narrow wiring space inside a small electronic device.

Since the cable harness 100 uses the shielded flat cable 10, for example, a shape of a 90° bent portion 23 which is formed so as to match a wiring space can be maintained without using a fixing member.

It should be noted that the invention is not intended to be limited to the embodiment, and the various kinds of embodiments can be implemented without departing from the gist of the invention.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A shielded flat cable, comprising:

a plurality of wires arranged in parallel;

a fibrous member comprising a polyurethane elastic fiber of 17 dtex to 45 dtex, the fibrous member being woven over and under the plurality of wires along an arrangement direction of the wires in a state that the fibrous member is elongated such that an outer diameter of the fibrous member is 0.04 mm or less; and a shield layer comprising a conductive member that includes an adhesive layer on one surface thereof and covers an entire periphery of the plurality of wires such that the adhesive layer is in contact with the fibrous member, wherein the fibrous member has an elongation percentage of not less than 500% and not more than 900%, a recovery percentage from elongation at 300% of not less than 90%, and an initial modulus for 300% elongation of not less than 5 cN/dtex and not more than 30 cN/dtex.

2. The shielded flat cable according to claim 1, wherein the fibrous member is expandable when being woven between the wires.

3. The shielded flat cable according to claim 1, wherein the fibrous member comprises a monofilament.

4. The shielded flat cable according to claim 1, wherein the shield layer is bonded to the fibrous member by thermal fusion bonding.

5. The shielded flat cable according to claim 1, wherein an inner conductor of the plurality of wires comprises a soft copper wire having an elongation of not less than 10%, a tensile strength of not less than 160 MPa and not more than 400 MPa, and a conductivity of not less than 95%.

6. The shielded flat cable according to claim 1, wherein the conductive member comprises a polyethylene terephthalate tape, a metal foil layer formed on one side of the polyethylene terephthalate tape, and the conductive adhesive layer formed on a surface of the metal foil layer.

7. The shielded flat cable according to claim 1, wherein the plurality of wires each comprise an outermost layer comprising a fluorine resin, have an outer diameter of not more than 0.28 mm, and are arranged at a wiring pitch of not more than 0.30 mm.

8. A cable harness, comprising:

the shielded flat cable according to claim 1; and a connector attached to a terminal portion of the shielded flat cable.

9. The shielded flat cable according to claim 1, wherein, in the state that the fibrous member is elongated, the fibrous member is elongated at an elongation of 300% or more.

10. The shielded flat cable according to claim 1, wherein the arrangement direction of the wires includes a direction of stacking of the wires such that the fibrous member extends along the direction of stacking of the wires.

11. The shielded flat cable according to claim 1, wherein the arrangement direction of the wires includes a perpendicular direction to a lateral direction of extension of the wires.

12. A shielded flat cable, comprising:

a plurality of wires arranged in parallel;

a fibrous member comprising a polyurethane elastic fiber, the fibrous member having an elongation percentage of not less than 500% and not more than 900%, the fibrous member being woven over and under the plurality of wires along an arrangement direction of the wires in a state that the fibrous member is elongated at an elongation of 300% or more; and a shield layer comprising a conductive member that includes an adhesive layer on one surface thereof and covers an entire periphery of the plurality of wires such that the adhesive layer is in contact with the fibrous member, wherein the fibrous member has a recovery percentage from elongation at 300% of not less than 90%, and an initial modulus for 300% elongation of not less than 5 cN/dtex and not more than 30 cN/dtex.

13. The shielded flat cable according to claim 12, wherein the polyurethane elastic fiber includes a fiber of 17 dtex to 45 dtex.

14. The shielded flat cable according to claim 12, wherein, in the state that the fibrous member is elongated, an outer diameter of the fibrous member is 0.04 mm or less.

15. The shielded flat cable according to claim 12, wherein the arrangement direction of the wires includes a perpendicular direction to a lateral direction of extension of the wires.

* * * * *